United States Patent [19]

Hampl, Jr. et al.

[11] Patent Number: 4,805,644

[45] Date of Patent: Feb. 21, 1989

[54] SIDESTREAM REDUCING CIGARETTE PAPER

[75] Inventors: Vladimir Hampl, Jr., Roswell; Robert D. Fields, Atlanta; Edward P. Bullwinkel, Roswell, all of Ga.

[73] Assignee: Kimberly-Clark Corporation, Neenah, Wis.

[21] Appl. No.: 880,213

[22] Filed: Jun. 30, 1986

[51] Int. Cl.[4] ..... A24D 1/02

[52] U.S. Cl. ..... 131/365; 131/342; 162/139

[58] Field of Search ..... 131/365, 335, 342; 162/139

[56] References Cited

U.S. PATENT DOCUMENTS

| | | | |
|---|---|---|---|
| 1,438,587 | 12/1922 | Feldenheimer . | |
| 1,438,588 | 12/1922 | Feldenheimer . | |
| 1,905,416 | 4/1933 | Low . | |
| 2,028,552 | 1/1936 | Low . | |
| 2,049,320 | 7/1936 | Ruben et al. . | |
| 2,181,614 | 11/1939 | Striefling . | |
| 2,933,420 | 4/1960 | Haden . | |
| 3,049,449 | 8/1962 | Allegrini . | |
| 3,744,496 | 7/1973 | McCarty et al. . | |
| 3,987,800 | 10/1976 | Aetho et al. . | |
| 4,033,359 | 7/1977 | Borthwick et al. . | |
| 4,108,151 | 8/1978 | Mactin et al. . | |
| 4,146,040 | 3/1979 | Cohn . | |
| 4,225,636 | 9/1980 | Cline et al. | 427/243 |
| 4,231,377 | 11/1980 | Cline et al. | 131/9 |
| 4,450,847 | 5/1984 | Owens | 131/365 |
| 4,452,259 | 6/1984 | Norman et al. | 131/349 |
| 4,453,553 | 6/1984 | Cohn | 131/365 |
| 4,461,311 | 7/1984 | Mathews et al. | 131/365 |

FOREIGN PATENT DOCUMENTS 85494 10/1983 European Pat. Off. .

*Primary Examiner*—V. Millin

*Attorney, Agent, or Firm*—William D. Herrick

[57] ABSTRACT

Sheet material especially useful in forming wrappers for smokeable articles such as cigarettes that results in reduced sidestream smoke. The sheet is formed by incorporating as a filler in a cellulosic web an amount of high (at least about 20 $M^2/g$) superficial surface area filler in the range generally of about 5 to 50 percent by weight in the finished sheet resulting in a web superficial surface area of at least about 80 $M^2$ per square meter of web. The cellulosic material may be flax fiber or other natural cellulosic fibers conventionally used for such wrappers. Additional fillers may be used up to a total of about 50 percent, and burn modifier salts included. Examples of salts include the sodium or potassium salts of acids such as carbonic, formic, acetic, propionic, malic, lactic, glycolic, citric, tartaric, fumaric, oxalic, malonic, succinic, nitric, and phosphoric. The sheet can be formed by any conventional papermaking method. When such papers are used as cigarette wrappers, they effect a reduction of the total particulate matter in sidestream smoke of up to about 70 percent without serious deterioration of other desirable properties. In addition the sheet of the invention provides normal ash appearance in a smoking article.

19 Claims, 2 Drawing Sheets

SIDESTREAM REDUCING CIGARETTE PAPER

BACKGROUND OF THE INVENTION

1. Field of the Invention

The present invention relates to wrappers for smoking products such as cigarettes. Cigarettes are conventionally made by wrapping tobacco in paper which is made from flax or other cellulosic fibers and calcium carbonate filler. Papers of this general description are standard in today's cigarettes and are available from a number of sources. The burning cigarette releases smoke which may be classified as sidestream when it emanates from the lit end of the cigarette or mainstream when it is drawn through the tobacco column to the smoker. The present invention is directed to an improved wrapper manufacturing method and resulting wrapper that materially reduces the quantity of sidestream smoke.

2. Description of the Art

Various attempts have been made to reduce the level of sidestream smoke. However, none has been successful to the point of significant commercial exploitation. For example, U.S. Pat. No. 4,225,636 to Cline et al issued Sept. 30, 1980 is directed to the use of high porosity carbon coated cigarette papers disclosed to provide substantial reductions in both mainstream and sidestream smoke. U.S. Pat. No. 3,744,496 to McCarty et al issued July 10, 1973 is also directed to a carbon filled wrapper which is preferably treated with compounds such as alkali metal hydroxides, bicarbonates and carbonates. It also has been recognized that some smoking articles wrapped in tobacco leaf release lower amounts of sidestream smoke, but such wrappers are not practical for use on cigarettes. These products, as well as those resulting from other attempts at sidestream reduction, have suffered either from excessive cost or adverse effects relating to mainstream particulate deliveries, draw, taste, or other factors such as burn rate. U.S. Pat. No. 4,461,311 to Mathews, Mattina and DeLucia dated July 24, 1984 describes a further improvement in wrappers incorporating extraordinary amounts of alkali metal salts. While successfully reducing sidestream smoke, cigarettes with such wrappers have exhibited taste modifications noticeable to some smokers. Therefore, none of these approaches has represented an entirely satisfactory solution for decreasing sidestream smoke from cigarettes.

As those skilled in this art will appreciate, it is conventional to incorporate any of a wide variety of filler compounds in papers for cigarette wrappers. The above-described U.S. Pat. No. 3,744,496 to McCarty et al issued July 19, 1973, for example, discloses the use of carbon as a filler. U.S. Pat. No. 4,461,311 to Mathews, Mattina and DeLucia teaches the use of calcium carbonate, and a series of patents to Cline or Cline et al., including U.S. Pat. No. 4,231,377 dated Nov. 4, 1980, teaches the use of various magnesium compound fillers. It has been also suggested that conventional clays may be one of a number of materials suitable as fillers for cigarette wrapper papers. Examples of such teachings include U.S. Pat. No. 2,181,614 to Striefling dated Nov. 28, 1939. Moreover, conventional clays have been taught as suitable for fillers for smokeable compositions, per se. Finally, fillers such as attapulgite clay are known for use in tobacco smoking preparations as taught in U.S. Pat. No. 3,049,449 to Allegrini dated Aug. 14, 1962, for example.

In spite of the foregoing information available to those skilled in this art, it remains desired to obtain improved reductions in sidestream smoke efficiently and without adverse effects on other smoking properties such as taste or ash color.

SUMMARY OF THE INVENTION

The present invention relates to a wrapper for a smokeable article and to the smoking article, itself, both providing substantial reduction in sidestream smoke without significant adverse effect on properties such as mainstream particulate matter and puff count. These results are obtained by modifying cigarette wrapper paper formulations. The paper formulation is modified to contain certain inorganic fillers in sufficient amount to provide a total superficial surface area of filler in the paper of greater than eighty square meters per one square meter of the paper. In addition, the paper contains one or more carboxylic acid salts in sufficient amount to result in a continuous, coherent ash when the cigarette or other smoking article is smoked. Surprisingly, the wrapper paper as decribed in the present invention results in a smoking article with very significant reductions in sidestream smoke while only minimally affecting other burn properties.

DESCRIPTION OF THE PREFERRED EMBODIMENTS

Figure 1:
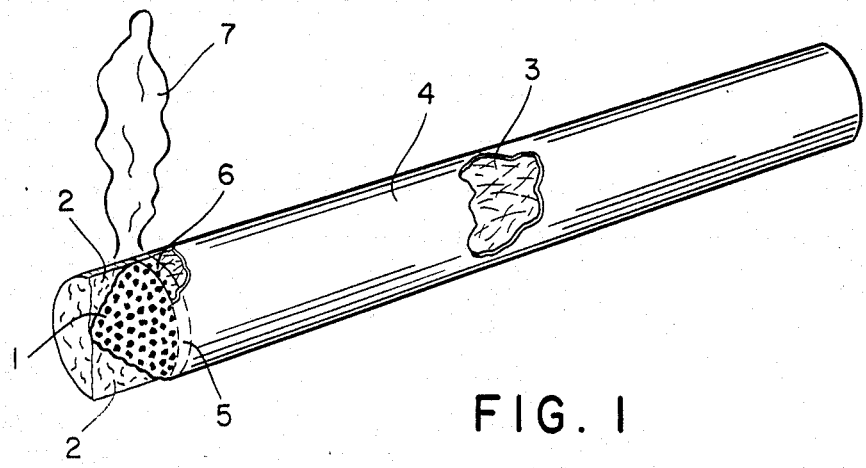
FIG. 1 is a schematic perspective view in partial section of a smoldering cigarette in accordance with the invention.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

During the smoking of a cigarette, a large fraction of the total smoke generated by combustion of the tobacco is released from the lit end of the cigarette as sidestream smoke. The relative amounts of mainstream and sidestream smoke in a given instance will depend upon the manner in which the cigarette is smoked. If the cigarette is placed in an ashtray for prolonged intervals between puffs, sidestream becomes a very large fraction of the total smoke produced. whether the cigarette is held by the smoker or rests in an ashtray during the interval between puffs, the sidestream rises as a concentrated and highly visible plume of smoke. Moreover, this concentrated plume continues to emanate from the lit end of a cigarette even while air is being drawn in during the puff, so that sidestream smoke is constantly released in large quantities throughout the consumption of a cigarette, regardless of whether consumption is largely by smoldering or by puffing. At times, the sidestream smoke plume is carried by air currents into the vicinity of other persons who may find it objectionable. Therefore, cigarettes producing markedly less sidestream are highly desirable.

In accordance with the present invention, sidestream smoke particulate matter is greatly reduced by modifications of the paper used to wrap the tobacco column. Prior attempts to reduce sidestream smoke by wrapper modifications have involved the use of papers which were technically or economically impractical, which modified taste, which were aesthetically unacceptable, or which resulted in drastically increased mainstream smoke delivery and puff count. In contrast, the modifications of the present invention do not result in retarded burn rate or elevated delivery of mainstream tar; they do not adversely affect the appearance of the cigarette or ash; and they do not require the use of exotic materials or manufacturing processes. For example, cigarettes made with the wrapper of the present invention afford normal enjoyment to the smoker but diminish the possibility of stray smoke being objectionable to bystanders.

In accordance with the invention, these highly desirable beneficial effects are obtained by using a particular type of filler in combination with one or more carboxylic acid salts in wrapper materials for smokeable articles. Such wrapper materials may otherwise be conventional cigarette papers made from flax and/or other cellulosic fibers containing, if desired, one or more other inorganic fillers, typically calcium carbonate. Other suitable mineral fillers will be apparent to those skilled in this art. The particular fillers include inorganic materials having a superficial surface area of at least about 20 $m^2/g$ and preferably at least about 25 $m^2/g$. They are useful in filler content ranges broadly of from about 5 percent to about 50 percent of paper by weight in accordance with this invention.

While the use of fillers and carboxylic acid salts has been known for many years as additives to cigarette papers for the purposes of improving burn characteristics, in conventional use the fillers are not normally selected from materials having the specified superficial surface area and in combination with carboxylic acid salts. The remainder of the paper composition of the present invention will comprise conventional materials such as cellulose fibers, preferably flax, other fillers and burn enhancers. Total superficial surface area for purposes of the present invention is defined generally as the difference between total surface area of the filler material and the surface area contributed by the voids or pores in the filler material.

While it is not desired to limit the invention to any particular theory, it is believed that the particular paper compositions described in this invention function by modifying certain mass transport processes occurring in a smoldering cigarette. This may be understood by referring to FIG. 1, which is a schematic perspective illustration of a smoldering cigarette in partial section. Hot cone of coal 1 and its accompanying inorganic ash 2 will advance gradually to the right towards the unburnt portion of the cigarette comprising a tobacco rod 3 and surrounded by a paper wrapper 4. Because of the very high temperature of coal 1 (about 900° C.) and concomitant combustion efficiencies, no visible smoke issues from the coal. However, in the intermediate region 5 between the advancing coal and the more distant parts of the unburnt cigarette, various destructive distillation and partial combustion processes occur. Externally region 5 may be observed as a black char line 6 which comprises the not yet completely combusted organic substance of the paper wrapper 4 along with the inorganic fillers incorporated originally in the wrappers.

As will be understood, char line 6 and its final combusted state (all inorganic in nature) are much more premeable than original wrapper 4. This condition permits the easy egress of visible smoke as evidenced by the rising plume 7 issuing from this region of a smoldering cigarette.

The nature and origin of this visible smoke may be understood by considering it as a fog, i.e., a suspension of small liquid droplets in a gas phase, resulting from the supercooling and spontaneous nucleation of the vapor phase of certain high boiling compounds generated in the above-mentioned destructive distillation process. Once such a fog is formed, it exhibits great stability and can only be depleted of its liquid droplet content by highly efficient mechanical filtration means not available at char line 6. In the practice of the present invention, this supercooling and spontaneous nucleation of the vapor phase is greatly diminished by incorporating certain fillers in the paper wrapper. These fillers function by providing enlarged condensing surface areas resulting in a large fraction of the fog droplet precursor vapors condensing as liquid layers on the cooler filler particle surfaces. Such phase transformations (gas - liquid) are extremely rapid and efficient, thus relieving the requisite supersaturation necessary for fog (smoke) generation.

It might be expected that this condensing mechanism would offer only temporary and inconsequential relief from smoke generation since the ever-advancing coal will soon re-boil these condensed liquids to yield the original vapors which are responsible for smoke generation in the first place. However, when this occurs, the re-boiling takes place on the outer periphery of the cigarette, where the ambient environment (air) is much enhanced in oxygen content compared to the interior of the cigarette where the vapors were first generated. Because of this enhanced oxygen content, these vapors are believed to be efficiently burnt or broken down to gaseous products which cannot nucleate to form visible smoke on cooling because of their lower molecular weight.

As described herein throughout the body of this document percent sidestream reduction results are demonstrated with reference to a control cigarette made with a conventional cigarette paper. This paper is characterized by a permeability of 30 cm/min (as measured by the CORESTA method at a pressure differential of 1 centibar), a basis weight of 25 $g/m^2$, a filler content of 30 percent chalk, a fiber content of 69 percent flax, and a burn promoter mixture of 0.3 percent potassium citrate and 0.6 percent sodium citrate. (The superficial surface area of the chalk in the control wrapper is only 3 $m^2/g$. Both the control cigarettes and cigarettes made in accordance with the invention wrappers contained the same, standard American tobacco blend with a bulk density of 0.265 $g/cm^3$.

Surface Area Requirements

Figure 2:
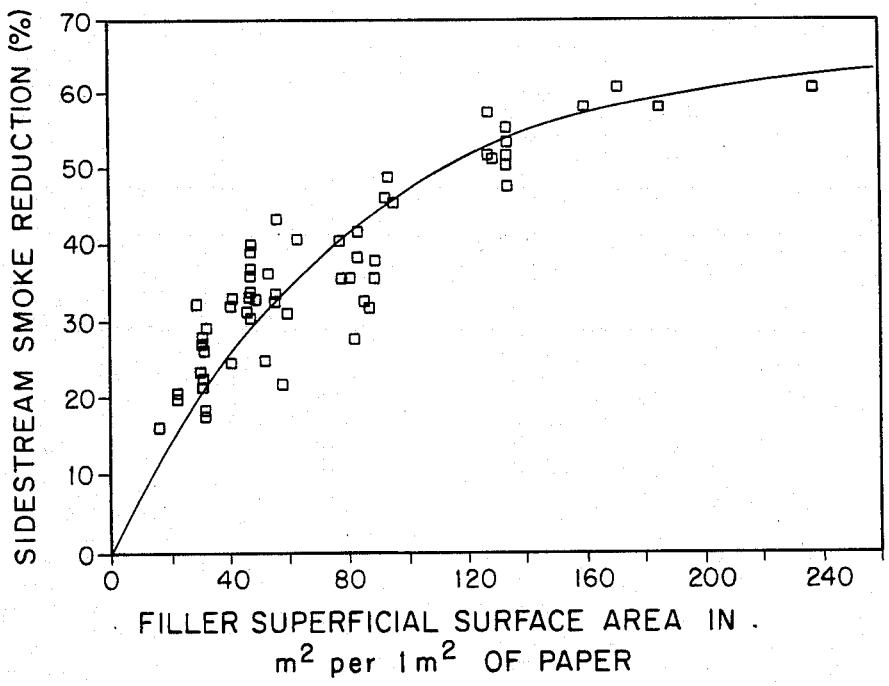
FIG. 2 is a graph illustrating improvements in sidestream smoke reduction in accordance with the invention as the surface area of filler in the cigarette paper increases.

As shown in FIG. 2, the percent sidestream smoke reduction initially incrases as the total superficial surface area of the filler in the paper increases. This total superficial surface area is the product of the specific superficial area of the filler in units of $m^2/g$, the weight fraction of filler in paper, and the basis weight of paper $g/m^2$. (The contribution of the fiber portion of the paper is negligible). It is further seen in FIG. 2 that the rate of increase in percent sidestream smoke reduction diminishes to nearly zero when the total superficial surface area in the paper exeeds 150 $m^2$ of filler per $m^2$ of paper. It is believed that this effect is caused by other rate limiting processes in the transport of gases being condensed on the condensing surface. In other words when sufficient condensing area is supplied, it no longer is the rate limiting step in the process of condensing the gaseous components.

Figure 3A:
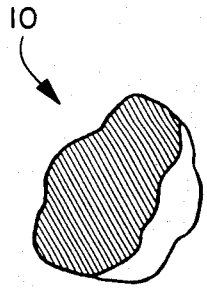
FIG. 3A illustrates schematically and in perspective and section a non-porous filler.
Figure 3B:
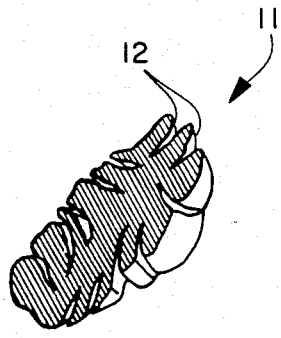
FIG. 3B illustrates schematically and in perspective and section a porous filler.

The specific superficial surface areas of the various fillers were obtained using the well known BET method [Brunauer, Emmett, Teller, J. Amer. Chem Soc. 60, 309 (1938)] and known properties of the porous nature of the particular filler. Since the BET method involves the adsorption of the very small nitrogen gas molecule, it gives the total surface area of the filler, which comprises the superficial surface area and the area contributed by any pores or voids in the actual filler particle. In accordance with the invention, the area provided by these voids or pores is ineffective as condensation sites since the time available in a smoldering cigarette will not permit the diffusion of gases into these pores or voids. Referring to FIGS. 3A and 3B, for example, there are shown two filler particles 10, 11 of the same superficial surface area but differing vastly in their total surface area due to fissures 12 as the section clearly demonstrates. A striking example is the use of zeolites, which are inherently porous because of the presence of minute pores arising from their unique crystal structure, as sidestream reducing fillers. If these molecular size pores are empty, the BET measurements for the adsorption of nitrogen give a total specific surface areas of about 150 $m^2/g$. However, if the zeolite has been exposed to water (such as would always be the case during paper making) these pores become completely filled with water molecules. These water molecules are so tenaciously held that subsequent BET measurements give only the superficial surface area of some 4 $m^2/g$. Consequently, zeolites are no more effective in reducing sidestream smoke than a nonporous filler of about the same superficial surface area, namely conventional chalk.

Most fillers which are of use in the practice of the invention are not porous, but are instead comprised of small impermeable crystals. In such cases the very convenient BET measurements may be used as a direct measure to evaluate the effective condensation area (superficial surface area).

Thermal Stability of the Filler Structure

The desired large surface area of the filler must not decrease significantly during heating of the filler as the hot coal approaches and passes by. Some filler, which have a large surface area at room temperature, fail to satisfy this requirement due to melting, fusing, or collapse of the filler particles. For example, the total surface area of a filler, Silcron 900, a silica hydrogel manufactured by SCM Pigments Corp., decreases drastically following exposure to elevated temperatures (from 47 $m^2/g$ to 6 $m^2/g$ following heating to 400° C.). If this former value is used, the predicted sidestream smoke reduction based on that value will not result. (The actual observed sidestream smoke reduction with this filler is in good agreement with data shown in FIG. 2 when the latter surface area value is used.)

It should not be inferred from the foregoing that all thermally unstable fillers lose surface area during heating. some fillers behave just the opposite and comprise an important class of sidestream smoke reducing fillers. These fillers in general are certain crystalline solids which on heating to modest temperatures chemically decompose to form new crystalline phases, which differ in density from that of the original solid. When this transformation occurs, the original crystals shatter and generate additional surface area. Examples of these fillers are hydrates ($CaSO_4.2H_2O$), hydroxides ($Ca(OH)_2$), carbonates ($MgCO_3$), peroxides ($MgO_2$). These compounds thermally decompose to yield a new crystalline phase and a gaseous byproduct ($H_2O$, $CO_2$, or $O_2$) in the temperature range of 200° to 500° C. To realize the advantage of this thermally generated surface area there must not be any liquid phase (such melting or eutectic formation) during the transformation. If this is not the case, the liquid will serve to sinter the filler particles together and lead to an actual decrease in surface area.

Effect of Carboxylic Acid Salts

Figure 4:
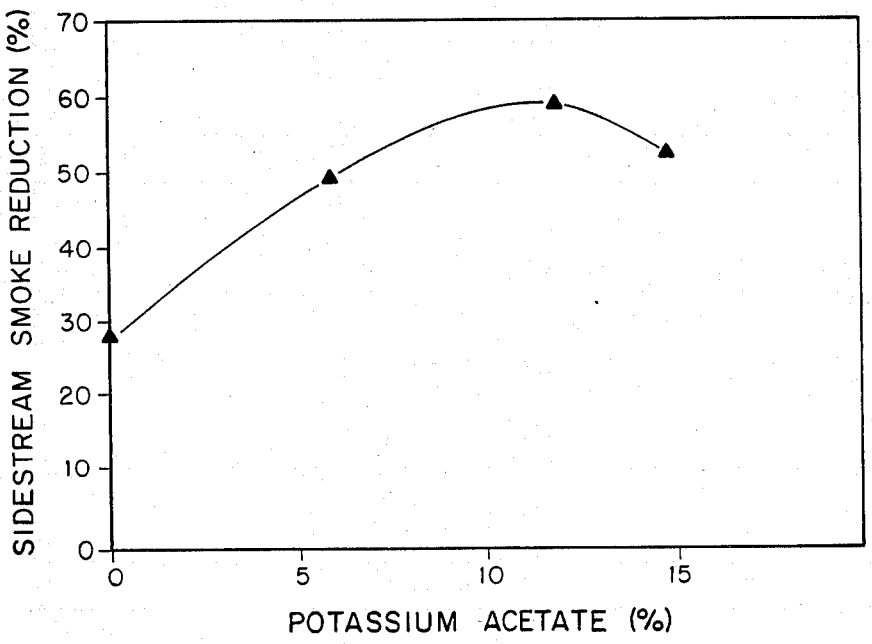
FIG. 4 is a graph illustrating the effect of addition of a carboxylic salt, namely potassium acetate, on sidestream smoke reduction in combination with a filler in accordance with the invention.

In addition to providing a large condensing surface the present invention also requires the presence of certain additives which serve to generate a coherent and continuous ash. This is achieved by incorporating carboxylic acid salts such as potassium citrate or sodium acetate into the paper, preferably at a level of 6 to 12 percent. These salts function by lightly sintering not only the char of the partially decomposed paper but also that of the final inorganic ash. If such salts are not provided, both the char and the ash structures will exhibit large cracks and fissures. Since in the interior of the cigarette the generated gases are at an appreciable positive pressure, they will preferantially escape through such fissures, completely bypassing the provided condensing surfaces. This obviously will vitiate the efficacy of the condensing sites. However, once the benefit obtained from the elimination of fissures is achieved, additional amounts of carboxylic acid salt will result in loss of surface area due to excessive sintering of the filler particles. Thus provision of an excess of a carboxylic acid salt (>12%) will actually worsen sidestream smoke reduction. These effects are shown in FIG. 4 where the sidestream reduction curve drops off after about 12 percent.

Aesthetic, Health, Manufacturing, and Economic Requirements

The filler must not only satisfy the criteria established above relating to surface area and thermal stability in order for it to be usable in cigarette paper, it should also provide attractive cigarette paper.

To be useful the filler obviously must meet health and safety requirements and preferably avoid insoluble salts of certain heavy metals, such as zinc, cadmium or lead, where during the combustion of the cigarette paper there is a potential for chemical reduction of the metal ions to yield poisonous metal vapors.

The filler in addition to providing condensation sites preferably is essentially water insoluble and affordable.

Examples of Suitable Filler Compositions (1) Clays

Attapulgite clay. This clay possesses a thermally stable, superficial surface area (200 $m^2/g$) which far exceeds that of more conventional clays, such a kaolinite or bentonite.

(2) Oxides

Fumes silica and alumina. Both of these oxides formed by burning of their respective chlorides have enormous superficial surface areas (200–600 $m^2/g$) and are thermally stable. This characteristic should be contrasted to that for more conventional hydrated silicas which collapse during heating and thereby lose their effectiveness in reducing sidestream smoke.

(3) Peroxides

Peroxides of magnesium, calcium and strontium can be used in this invention. They all decompose thermally at modest temperatures to yield increased superficial surface areas.

(4) Carbonates

Carbonates of magnesium, calsium, strontium and barium, which possess superficial surface areas exceeding about 20 $m^2/g$, can be used in this invention. (These carbonates can be distinguished from the conventional carbonates of commerce, which possess a superficial surface area $<10$ $m^2/g$.)

(5) Phosphates

Phosphates of magnesium, strontium, and barium, which possess superficial surface areas exceeding about 20 $m^2/g$, can be used in this invention.

(6) Sulphates

Sulphates of calcium, strontium and barium, which possess superficial surface areas exceeding about 20 $m^2/g$, can be used in this invention.

(7) Aluminates

Aluminates of magnesium, calcium, strontium, and barium, which possess superficial surface areas exceeding about 20 $m^2/g$, can be used in this invention.

(8) Silicates

Silicates of magnesium, calcium, strontium, barium, sodium, and potassium, which possess superficial surface areas exceeding about 20 $m^2/g$, can be used in this invention. Only those sodium and potassium silicates which are water insoluble can be used.

EXAMPLES

Example 1

A cigarette wrapper was made containing 50 percent flax fibers, 10 percent attapulgite clay (Attagel 40 manufactured by the Engelhard Chemicals Co.), 30 percent chalk, and 10 percent potassium acetate as a burn additive to sinter the ash and provide a coherent and continuous ash. The wrapper had a basis weight of 40 $g/m^2$ and a CORESTA permeability of 12 cm/min. A cigarette paper of this composition has about 125 $m^2$ of superficial surface area per $m^2$ of paper. Cigarettes were made with this wrapper at a length of 70 mm, without filters and with a standard American tobacco blend with a density of 0.265 $g/cm^3$. The sidestream reduction achieved with these cigarettes compared to the control cigarettes (conventional cigarettes) described previously was about 50 percent.

Example 2

Example 1 was repeated except that a potassium acetate was replaced with potassium citrate. The sidestream smoke reduction remained approximately the same at 50 percent.

Example 3

Example 1 was repeated except that the attapulgite clay content was increased to 15 percent and the chalk content was reduced to 25 percent. Cigarette paper of this composition has a superficial surface area of about 160 $m^2$ per $m^2$ of paper. The sidestream smoke reduction was about 55 percent.

Example 4

Example 1 was repeated except that the attapulgite clay content was increased to 20 percent and the chalk content was reduced to 20 percent. Cigarette paper of this composition has a superficial surface area of approximately 200 $m^2$ per $m^2$ of this paper. The sidestream smoke reduction was about 60 percent.

Example 5

Example 4 was repeated except that the basis weight of the paper was reduced to 35 $g/m^2$. Cigarette paper of this composition and basis weight has a superficial surface area of approximately 175 $m^2$ of paper. The sidestream smoke reduction was about 55 percent.

Example 6

A cigarette paper was made containing 50 percent flax fiber, 40 percent fumed alumina (Alumina Oxid C, manufactured by the Degussa Corp.), and 10 percent potassium citrate. The wrapper had a basis weight of 40 $g/m^2$ and a CORESTA permeability of 10 cm/min. A cigarette paper of this composition has a superficial surface area of approximately 400 $m^2$ per $m^2$ of paper. Cigarettes were made as in Example 1. The sidestream smoke reduction was nearly 70 percent.

Example 7

Example 6 was repeated except that the content of fumed alumina was reduced to 20 percent and the portion taken out was replaced with chalk. The cigarette paper of this composition had a superficial surface area of approximately 225 $m^2$ per $m^2$ of paper. The sidestream smoke reduction was about 65 percent.

Example 8

A cigarette wrapper was made containing 50 percent flax fiber, 40 percent activated alumina (Grade CP2 manufactured by the Alcoa Co.), and 10 percent potassium citrate. The wrapper had a basis weight of 40 $g/m^2$ and a CORESTA permeability of 15 cm/min. The cigarette paper of this composition had a superficial surface area of about 140 $m^2$ per $m^2$ of paper. The sidestream smoke reduction was about 50 percent.

Example 9

A cigarette paper was made containing 50 percent flax fiber, 20 percent fumed silica (Cabosil EH-5 manufactured by the Cabot Corp.), 20 percent chalk and 10 percent potassium acetate. The wrapper had a basis weight of 40 $g/m^2$ and a CORESTA permeability of 12 cm/min. The cigarette paper of this composition had an exceedingly high superficial surface area of over 1000 $m^2$ per $m^2$ of paper. The sidestream smoke reduction was about 65 percent, however, the ash was nearly black.

Example 10

Example 9 was repeated except that fumed silica content was increased to 40 percent and chalk was not included in the paper composition. The sidestream smoke reduction was about 65 percent and the ash was also nearly black.

While the examples are illustrated using calcium carbonate as an additional filler, other fillers may be used in combination with the high superficial surface area filler or it may constitute the only filler. Also, the burn enhancer may vary as to composition, for example sodium citrate or sodium acetate may be used, and in amount, for example, from about 6 percent up to about 15 percent by weight. It will be recognized by those skilled in the art that the shape of the curve of FIG. 2 will be consistent although it may shift somewhat with different tobacco compositions. In accordance with the invention, the curve is believed characteristic and the described effect on sidestream reduction occurs in each case.

It is a further result of particularly preferred embodiments of the present invention that the cigarette ash is very similar to the ash on conventional cigarettes. This is particularly significant with attapulgite clay, fumed alumina and activated alumina since some other high surface area fillers such as fumed silica (380 $m^2/g$) while reducing sidestream smoke, tend to result in a dark ash.

Modifying any conventional cigarette paper formulation by the addition of such fillers in accordance with the invention, results in a decrease in the level of sidestream smoke. However, the effect of this treatment can be maximized by using paper with low porosity and by maintaining sheet bulk at a high level consistent with low porosity. For a given level of filler addition, lower porosity causes further decreases in sidestream smoke. In accordance with preferred embodiments of the invention the paper porosity is in the range of from 5 to 30. The porosities are expressed as CORESTA permeability (superficial velocity, in centimeters per minute, of air flowing through a porous paper at a pressure differential of one centibar).

Thus it is apparent that there has been provided, in accordance with the invention, a sheet material adapted for use as a wrapper for smoking articles that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In a web material adapted for use as a wrapper for smoking articles, said material comprising a cellulosic base web having a substantially water insoluble and thermally stable filler having a superficial surface area in the range of at least about twenty $M^2/g$ providing a superficial surface area in the web of at least eighty square meters per square meter of web and containing up to about 15 percent by weight of an alkali metal salt.

2. The material of claim 1 wherein the filler has a superficial surface area in the range of at least about 25 $m^2/g$.

3. The material of claim 1 wherein the filler is selected from the group consisting of substantially water insoluble clays, oxides, peroxides, carbonates, phosphates, sulphates, aluminates and silicates.

4. The material of claim 1 wherein the filler is attapulgite clay.

5. The material of claim 1 wherein the filler is fumed alumina.

6. The material of claim 1 wherein the alkali metal salt is selected from the group consisting of sodium and potassium salts of carbonic acid, formic acid, acetic acid, propionic acid, malic acid, lactic acid, glycolic acid, citric acid, tartaric acid, fumaric acid, oxalic acid, malonic acid, nitric acid, and phosphoric acid.

7. The material of claim 6 wherein the salt is selected from the group consisting of sodium citrate and potassium citrate.

8. The material of claim 1 wherein the base web comprises flax fibers.

9. The material of claim 8 having a porosity of up to about 30 cm/min.

10. The material of claim 9 wherein the amount of filler is in the range of from about 5 to 50 percent by weight.

11. The material of claim 1 wherein the web also contains an inorganic filler.

12. The material of claim 11 wherein the additional inorganic filler is calcium carbonate.

13. The material of claim 1 wherein the base web has a permeability of up to about 30 cm/min.

14. The material of claim 1 wherein the filler is selected from the group consisting of attapulgite clay, fumed silica and alumina, peroxides of magnesium, calcium and strontium, carbonates of magnesium, calcium, strontium and barium, phosphates of magnesium, strontium and barium, sulphates of calcium, strontium and barium, aluminates of magnesium, calcium, strontium and barium, and silicates of magnesium, calcium, strontium, barium, sodium and potassium.

15. A smoking article comprising a tobacco rod surrounded by a wrapper wherein the wrapper comprises a cellulosic base web having a substantially water insoluble and thermally stable filler having a superficial surface area in the range of at least about twenty $M^2/g$ providing a superficial surface area of at least eighty square meters per square meter of paper and containing up to about 15 percent by weight of an alkali metal salt.

16. A smoking article as in claim 15 wherein the filler has a superficial surface area in the range of at least about 25 $m^2/g$.

17. A smoking article as in claim 16 wherein the filler is selected from the group consisting of attapulgite clay, fumed silica and alumina, peroxides of magnesium calcium and strontium, carbonates of magnesium, calcium, strontium and barium, phosphates of magnesium, strontium and barium, sulphates of calcium, strontium and barium aluminates of magnesium, calcium, strontium and barium, and silicates of magnesium, calcium, strontium, barium, sodium and potassium.

18. A smoking article as in claim 17 wherein the filler is attapulgite clay.

19. A smoking article as in claim 19 wherein the filler is fumed alumina.

* * * * *

UNITED STATES PATENT AND TRADEMARK OFFICE

CERTIFICATE OF CORRECTION

PATENT NO. : 4,805,644

DATED : February 21, 1989

INVENTOR(S) : Vladimir Hampl, Jr., Robert D. Fields, and Edward P. Bullwinkel

It is certified that error appears in the above—identified patent and that said Letters Patent is hereby corrected as shown below:

Column 1, line 55, "July 19, 1973" should read --July 10, 1973--;

Column 2, line 63, "whether" should read --Whether--;

Column 6, line 5, "some" should read --Some--;

Column 4, line 61, "3 $m^2/g$" should read --3 $m^2/g$.)--;

Column 8, line 16, "175 $m^2$ of paper" should read --175 $m^2$ per $m^2$ of paper--;

Column 10, line 60, "claim 19" should read --claim 17--.

Signed and Sealed this

Eleventh Day of August, 1992

*Attest:*

*Attesting Officer*

DOUGLAS B. COMER

*Acting Commissioner of Patents and Trademarks*